US008046935B2

(12) United States Patent
Parisi

(10) Patent No.: US 8,046,935 B2
(45) Date of Patent: Nov. 1, 2011

(54) FOOTWEAR PROTECTION DEVICE

(76) Inventor: Christopher Parisi, Fairfield, CT (US)

( * ) Notice: Subject to any disclaimer, the term of this patent is extended or adjusted under 35 U.S.C. 154(b) by 954 days.

(21) Appl. No.: 12/017,790

(22) Filed: Jan. 22, 2008

(65) Prior Publication Data

US 2009/0019735 A1 Jan. 22, 2009

Related U.S. Application Data

(60) Provisional application No. 60/885,779, filed on Jan. 19, 2007.

(51) Int. Cl.
*A41D 17/02* (2006.01)

(52) U.S. Cl. ..... 36/2 R

(58) Field of Classification Search ..... 36/2 R, 36/1.5, 101, 7.1 R
See application file for complete search history.

(56) References Cited

U.S. PATENT DOCUMENTS 2,097,200 A * 10/1937 Menutole ..... 36/1.5
2,099,476 A * 11/1937 Glowka ..... 36/2 R
2,247,831 A * 7/1941 Asch et al. ..... 36/2 R
3,083,373 A * 4/1963 Rizzotto ..... 2/270
4,542,597 A * 9/1985 Baptista et al. ..... 36/2 R
4,713,895 A * 12/1987 Vallieres ..... 36/1.5
4,896,437 A * 1/1990 Johnson ..... 36/1.5
5,144,759 A 9/1992 Mascotte
5,337,491 A * 8/1994 Mascotte ..... 36/7.1 R
D369,455 S * 5/1996 Halvorson ..... D2/901
5,544,430 A * 8/1996 Jacko ..... 36/7.1 R
7,219,443 B2 * 5/2007 Czaplewski et al. ..... 36/7.3
7,428,787 B2 * 9/2008 Crowley et al. ..... 36/2 R
2003/0097765 A1 * 5/2003 Chen ..... 36/2 R
2005/0268496 A1 12/2005 Bruce et al.
2008/0155863 A1 * 7/2008 Shor et al. ..... 36/2 R

OTHER PUBLICATIONS

International Search Report, PCT/US2008/051644, mailed Jun. 1, 2009.

* cited by examiner

*Primary Examiner* — Ted Kavanaugh

(57) ABSTRACT

An apparatus including a flexible first member for removable attachment to a footwear device and a second member attached to the first member for interacting with the footwear device and being configured to sweep foreign objects away from and prevent entry of the foreign objects into an interior of the footwear device.

18 Claims, 8 Drawing Sheets

FOOTWEAR PROTECTION DEVICE

CROSS-REFERENCE TO RELATED APPLICATIONS

This application claims priority to and the benefit of Provisional U.S. Patent Application No. 60/885,779 filed on 19 Jan. 2007, the disclosure of which is incorporated herein by reference in its entirety.

BACKGROUND

1. Field

The disclosed embodiments generally relate to footwear and, more particularly, to preventing debris from entering footwear.

2. Brief Description of Related Developments

The recent development and construction of synthetic turf fields has expanded at an exceptional rate. Their popularity has created new problems for athletes, coaches, officials, athletic directors and custodians. One of the problems is that the rubber pellets, also known as "infill" or "rubber infill", used to provide the artificial soil for the turf grass, accumulate inside the cleats and turf shoes of all who venture out onto the field. These rubber pellets typically infiltrate the shoes along the seam where the shoe upper meets the sock or leg of the participant. This infiltration is pervasive and has been an unavoidable cost of playing on synthetic turf fields. The accumulation of rubber pellets in the bottom of one's shoes or other athletic footwear can produce, among other things, foot discomfort and pain, cause emotional irritability, reduce athletic performance, alter balance and create a mess in hallways and locker rooms.

It would be advantageous to provide a device to substantially prevent foreign objects or debris from entering the shoe, particularly through the seam where the shoe upper meets the sock or leg of the participant, without substantially altering or impairing the performance of the shoe or individual.

SUMMARY

In one aspect of the disclosed embodiments, an apparatus is provided. The apparatus includes a flexible first member for removable attachment to a footwear device and a second member attached to the first member for interacting with the footwear device and being configured to sweep foreign objects away from and prevent entry of the foreign objects into an interior of the footwear device.

In another aspect of the disclosed embodiments, a debris protection device for footwear is provided. The debris protection device for footwear includes a substantially funnel shaped device having a top portion configured to frictionally bond to a leg of the user and a bottom portion configured to frictionally bond to an upper portion of the footwear and at least one bristle member affixed along the bottom portion configured to sweep foreign objects away from entering an interior of the footwear.

In still another aspect of the disclosed embodiments, an apparatus is provided. The apparatus includes a flexible protection device for removable attachment to a footwear device and a rear taper support affixed to the flexible protection device, the rear taper support being configured to translate pressure up sides of the protection device to a front of the protection device to prevent the protection device from riding up the rear of the footwear device.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE EXEMPLARY EMBODIMENT(s)

Figure 1A:
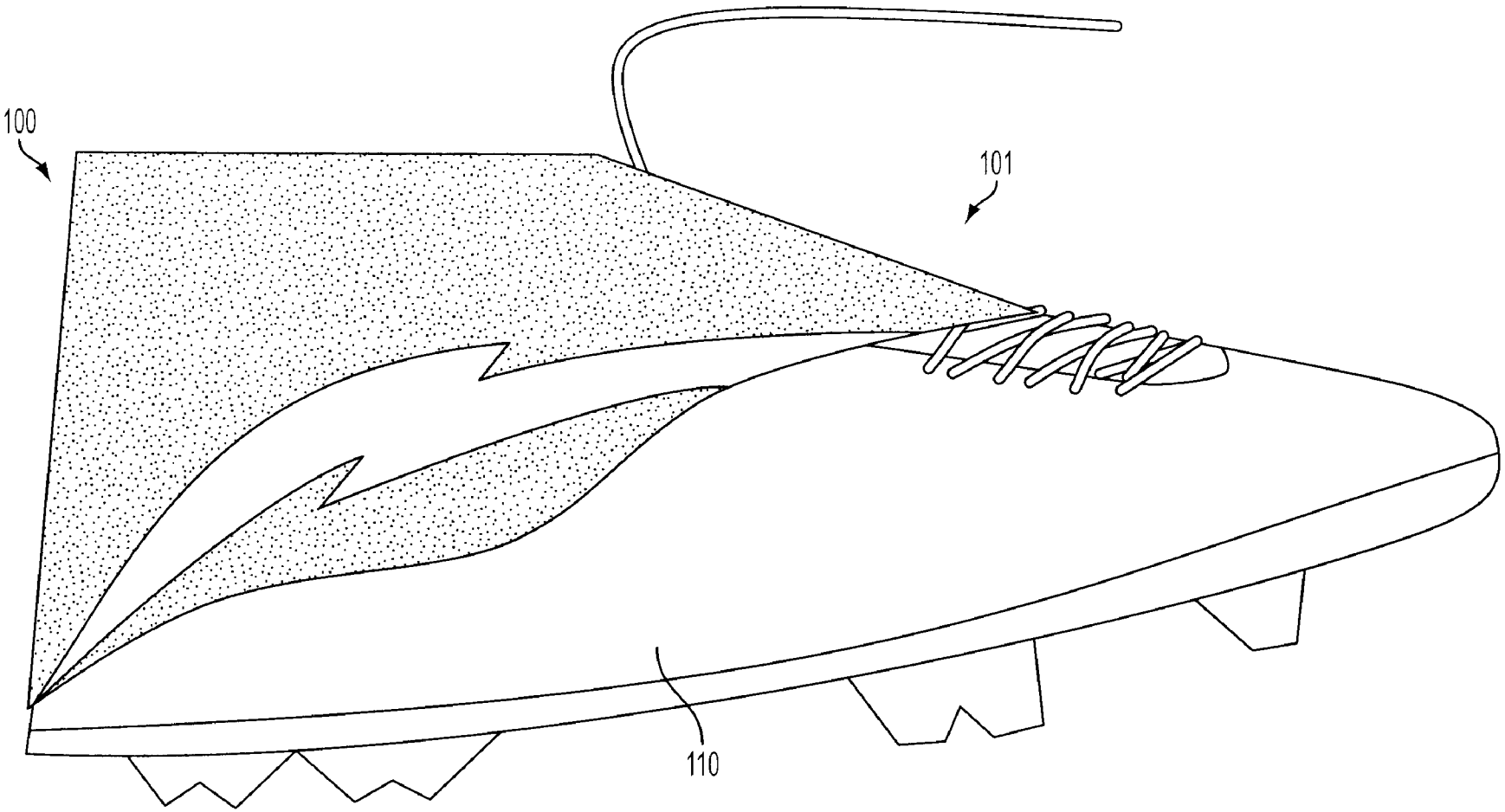
FIGS. 1A, 1B and 1C illustrate debris protection devices in accordance with aspects of the disclosed embodiments.

FIG. 1A illustrates a debris protection device 100 in cooperation with a shoe 110 in accordance with an exemplary embodiment. Although the embodiments disclosed will be described with reference to the embodiments shown in the drawings, it should be understood that the embodiments disclosed can be embodied in many alternate forms of embodiments. In addition, any suitable size, shape or type of elements or materials could be used.

Figure 1C:
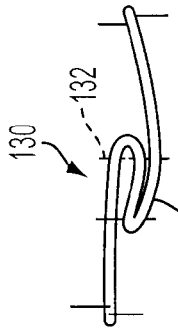
Figure 1B:
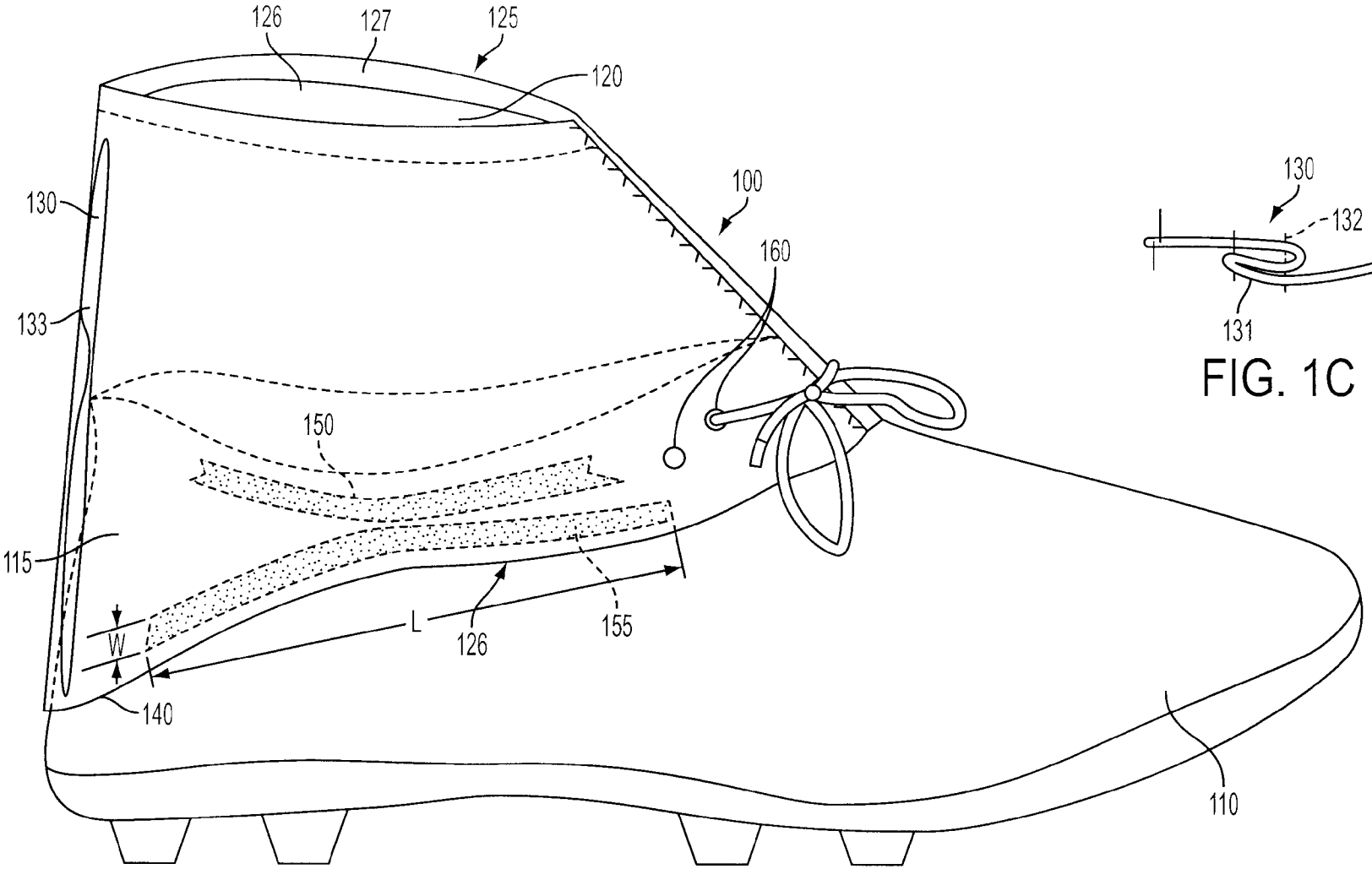

Referring to FIGS. 1A-1C, the debris protection device also referred to as ankle armor 100, is a system 101 designed to provide a substantial barrier against and/or channel debris, such as for example the above-described turf field or rubberized pellets or infill, away from entering the inside of footwear, such as for example, shoe 110, without impairing the performance of the user (e.g. athletic performance or otherwise). The debris protection system 101 will provide a comfortable and flexible device that will adapt to and/or universally fit all makes of footwear, athletic shoes and all sizes of ankles. For descriptive purposes the term "shoe" will be used herein. Although the disclosed embodiments are described herein as preventing the entry of rubber pellets from synthetic turf fields into low-cut athletic footwear, it is noted that the debris protection device 100 is configured to generally prevent the entry of any type of debris that might be kicked up by a shoe(s) 110 from entering the interior of the shoe(s) 110. As noted earlier, artifacts, also referred to as debris, can generally get into the user's footwear through the area at the top of the shoe around the ankle. Artifacts, such as the turf in full described herein can get into a shoe through this area. The debris protection device 100 can be used by runners to prevent dirt and beach sand from entering their shoes, by outdoor workers to prevent mulch, dirt, sticks or grass from entering their boots, or by children on a playground to prevent dirt and debris from entering their shoes. Golfers can apply the device 100 to prevent grass clippings, or even water, from adhering to socks and/or entering the golf shoe. In one embodiment, the debris protection device 100 could be configured to be applied to a dress type of footwear, to prevent dirt, sand, gravel or such other similar types of debris from falling into the footwear, where such conditions exist or dictate. In one embodiment, a reverse funnel design prevents debris penetration along the upper and lateral edges of the device 100 and an internal sweep device reduces debris entry from below.

In one embodiment, the debris protection device 100 is shaped and constructed to form a friction bond at points of contact between the device 100 and the ankle/lower leg of a user and between the device 100 and the shoe 110. In alternate embodiments, any suitable mechanism can be used to secure the device to the wearer's leg, including for example, straps, laces or other such tying or adjustment mechanisms. In one embodiment a strap mechanism can be built into or affixed to an upper region of the device. The user can tighten the upper region mechanism to a desired fit. The device 100 is generally configured to substantially cover an opening between the ankle part of the user and the shoe so that debris is directed away and prevented from entering the shoe 110.

In one embodiment when the debris protection device is in place the device extends from an area on the leg near the ankle down the foot or ankle of the user and past and over the opening between the ankle part of the user and the shoe 110 and onto at least the upper portion 115 of the shoe 110. The device 100 can be secured to the shoe 110 at or near the contact points by friction or other attachment device(s). The methods of securing the device 100 to the shoe 110 may also be used separately or in conjunction with each other. These other methods of securing the device 100 include, but are not limited to, grommets 160A, 160B, hooks 161, straps 162, snaps and Velcro, for example. It is noted that the positions of the grommets 160A, 160B, hooks 161 and straps 162 shown in FIGS. 1B, 2B and 3 are for exemplary purposes only and that the devices, of any suitable number, can be suitably located on any portion of the device 100 for securing the device 100 to the shoe 110. For example, an inner edge of the lower area 126 of the device 100 may include one or more Velcro strips. These Velcro strips can be mated to complementary strips that are affixed to corresponding areas on the shoe. Similarly, snaps can be affixed along a periphery of the lower area 126 of the device 100 that mate with complementary snaps affixed to or on the shoe.

Figure 4:
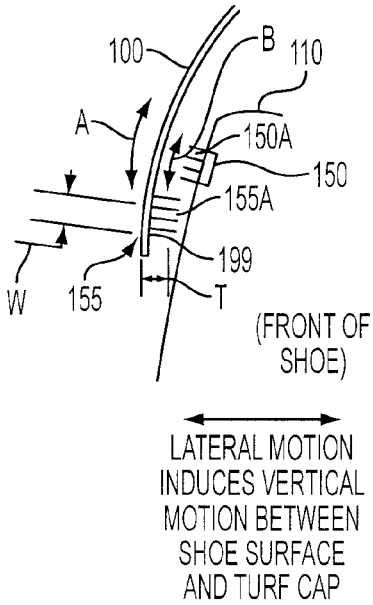
FIG. 4 illustrates a portion of the debris protection device in accordance with the disclosed embodiments.

In another embodiment, a second device can be used in conjunction with the debris protection device 100 to prevent debris from entering into the shoe. Referring to FIGS. 1B, 3 and 4, a barrier, such as for example the ridgeline 155, can be secured on an inner edge area 199 of the region 198 of the debris protection device 100. An additional or complementary ridgeline 150 can be attached to the lateral sides of the outer throat region of the shoe 110. The ridgelines 150, 155 can be respectively attached to the shoe 110 and the device 100 by stitching, adhesives, snaps, Velcro or some other suitable alternative mechanical or chemical fasteners. The ridgelines 150, 155 can be any suitable dimensions (e.g. length L, width, W and thickness T). In one embodiment, the ridgelines 150, 155 may extend along one or more portions of the sides of the shoe 110 as shown in FIG. 1B or they may extend around a circumference of the upper portion 115 of the shoe. The ridgelines can be oriented in any suitable fashion. In one embodiment the ridgelines 150, 155 may have the same dimensions while in other embodiments the dimensions of ridgeline 150 may be different than the dimensions of ridgeline 155. The size and orientation of the ridgelines should be such to maximize the interaction of the complimentary ridgelines as described herein. The ridgelines 150, 155 can include, for example, any suitable number of elements, such as bristles, 150A, 155A having any suitable shape and/or size for interacting with each other, the shoe 110 (in the case of ridgeline 155) and/or with the device 100 (in the case of ridgeline 150). The elements 150A, 155A can be constructed of any suitable material including, but not limited to, polyester, plastic, nylon, neoprene or any other material capable of being formed into sweeping devices, such as bristles. In one embodiment, the ridgelines 150, 155 may be formed of the same material as the device 100 while in other embodiments the ridgelines 150, 155 may be formed with a material that is different than the material of the device 100.

In one embodiment, the ridgelines 150, 155 generally configured to prevent the entry of debris into the shoe 110 by forming a moving barrier along the area between the outer sides of the shoe and an inner region of the device 100. For example, in one embodiment as lateral movement is introduced to the shoe during use, the ridgelines 150, 155 will slide apart and together in the direction of arrows A, B (FIG. 4). As the ridgelines 150, 155 slide apart and together, the elements 150A, 155A sweep particles or debris in these areas away from entering the inside of the shoe. In this way, the natural flexion of the user's foot produces a substantially periodic or constant up-and-down sweeping of the sides of the shoe. Although the sweeping motion is described with respect to both of the ridgelines 150, 155, it is noted that the same debris sweeping effect may be achieved through one ridgeline. In other embodiments more than two ridgelines may be used. Although micro-bristles are described herein, any suitable material or device can be used that will effectively sweep any debris or particles away and prevent entry into the footwear. It is noted that the ridgelines 150, 155 are configured to also prevent entry of debris into the shoe 110 when the ridgelines 150, 155 are stationary with respect to one another. For example, in one embodiment the interaction of the elements 155A with the shoe 110 and the interaction of the elements 150A with the device 100 can substantially form a seal (e.g. through the interaction of the elements with the fibers of the mating material) for preventing the passage of debris by the ridgelines 150, 155.

As shown in FIG. 1B, the one or more ridgelines 155 are positioned along or substantially adjacent to a peripheral edge of the the lower portion 126 of the device 100. The ridgeline 155 is generally configured to provide a firm yet flexible barrier between the device 100 and the shoe 110 to prevent debris from entering an an area between an outside of the shoe 110 and the inside of the device 100. As shown in FIG. 1B., the ridgeline 155 can be configured to extend along a portion of the underside of the device 100, generally or substantially along a peripheral edge of the device 100. In alternate embodiments the ridgeline 155 can be configured to extend along a substantial entirety of the peripheral edge of the device 100.

Other ridgelines 150 may also be provided on the shoe 110 for interacting with the ridgelines 155 on the device 100. The ridgelines 155 move against the shoe 100 while ridgelines 150 move against the debris protection device 100 and/or ridgelines 155 to sweep away and prevent any debris that migrates upwards between the device 100 and shoe 110 from entering the interior of the shoe 110. In one embodiment, the ridgeline 155 can move against the complimentary ridgelines 150. Movement of the user's foot causes the sweeping action of the ridgelines 150, 155 to allow for removal of debris that may collect from between the device 100 and the shoe 110.

Figure 5A:
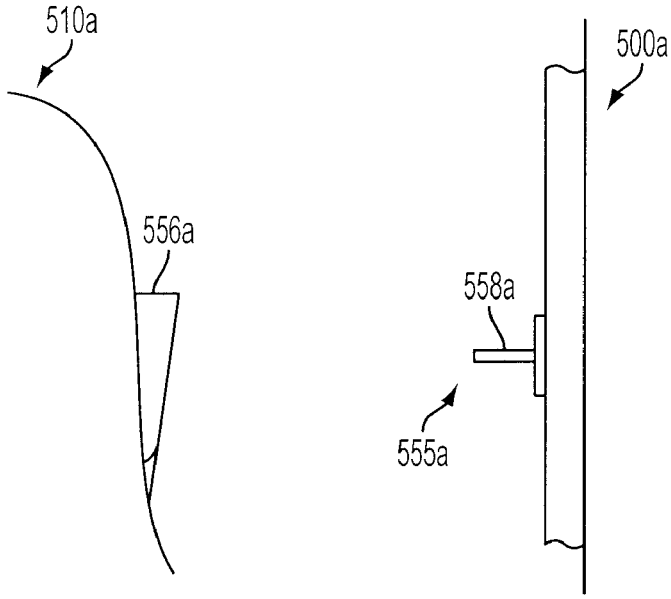
FIGS. 5A-5D illustrate examples of the ridge line device.

The ridgeline 155 is generally configured to prevent or reduce the entry of debris into the shoe 110 from the bottom side of the device 100. During activity, debris is likely to kick up and become trapped between an inside portion of the device 100 and the shoe 110. To prevent this debris from migrating upwards and entering the shoe, the ridgeline 155 is generally configured to provide a barrier and/or sweep any debris away. In one embodiment the ridgeline 155 can comprise a bristle or brush type device. Referring to FIG. 5A, a side view of one embodiment of a bristle sweep device 555*a* in cooperation with the device 500*a* is illustrated. In this example the bristle device 555*a* includes a sweeping element 558*a* that generally extends in a substantially perpendicular orientation from the inside of the device 500*a* towards the shoe 510*a*. The spacing between the shoe 510*a* and the device

500*a* is not to scale in these examples. During activity there will be some movement of the shoe 510*a* and the device 500*a* corresponding to the user's movement. As the device 500*a* moves in a downward direction relative to the shoe 510*a* the bristle element 558*a* will push or sweep any debris towards the bottom most opening between the shoe 510*a* and the device 500*a*. When the device 500*a* is moving in an upward direction relative to the shoe 510*a* the element 558*a* is configured to substantially prevent any debris from entering an area above the element 558*a*. Although only one element 558*a* is shown, in alternate embodiments any suitable number of elements can comprise the device 555*a*.

As shown in FIG. 5A, a complementary ridgeline device 556*a* can be provided on the shoe 510*a*. The complementary ridgeline device 556*a* is generally configured to interact with the ridgeline element 558*a*. The complementary ridgeline device 556*a* can be affixed to the shoe in any suitable fashion including adhesives or mechanical fasteners. As shown in FIG. 5A, in one embodiment, the ridgeline device 556*a* is tapered. The taper is configured to substantially prevent the entry of debris when the ridgeline element 558*a* is an uppermost position and then allow the ridgeline element 558*a* to sweep any collected debris away. In alternate embodiments, the ridgeline device 556*a* does not need to be tapered. In one embodiment the complementary ridgeline device 556*a* can be a material that traps passing debris but allows the debris to be swept off when the ridgeline element 558*a* is moving in a downward direction toward the bottom of the shoe 510*a*. Although the embodiments herein are described with respect to the movement of the device 500*a*, in alternate embodiments the movement can be of the shoe 510*a* with respect to the device 500*a*.

Figure 5B:
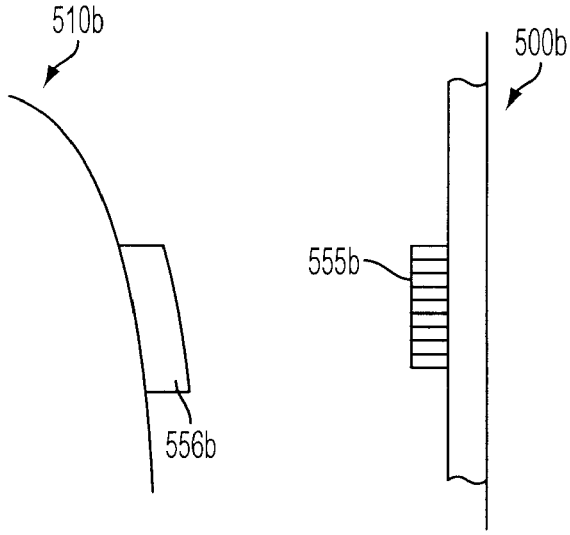

The ridgeline element 558*a* can comprise any one of a number of suitable materials. These can include for example, brushes, bristles, micro bristles, Velcro and rubberized materials. FIG. 5B illustrates an embodiment where the ridgeline device 555*b* comprises a Velcro strip. A complementary Velcro strip 556 can be affixed to the shoe 510*b*. In an alternate embodiment the ridgeline element 558*a* can comprise a rubberized material or channel. The shape of the element 558*a* can comprise any suitable shape that will trap debris and sweep debris.

Figure 5C:
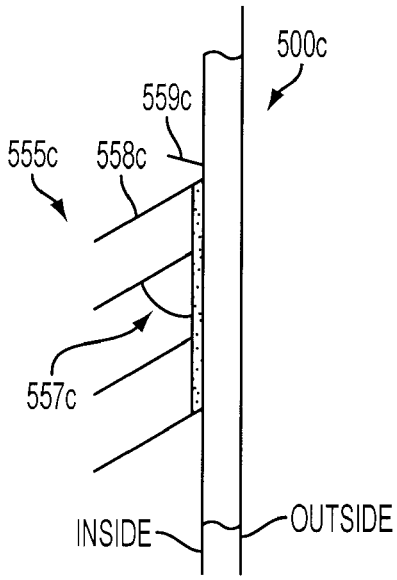
Figure 5D:
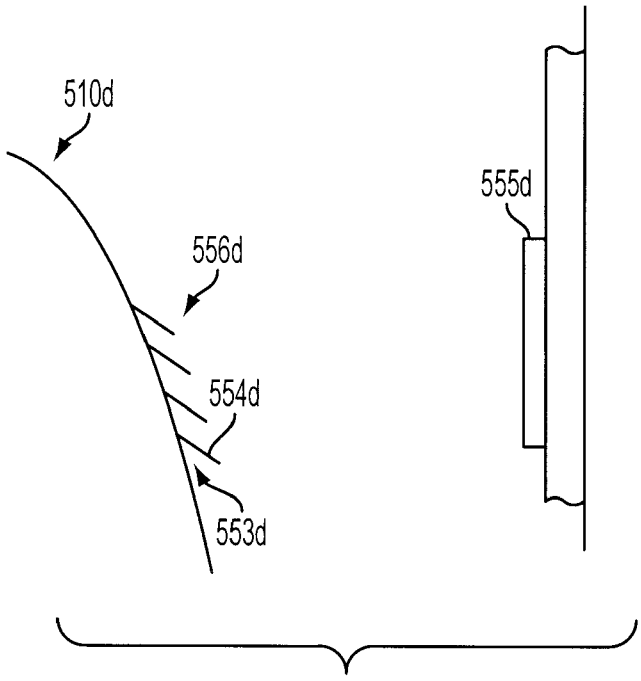

FIG. 5C illustrates an example of a ridgeline device 555*a* where a plurality of ridgeline elements 558*c* is used. In this example the ridgeline elements 558*c* have a normal position where an angle 557*c* is less than 90°. When the device 500*c* is moving an upward direction the ridgeline elements 558*c* will trap any entering debris. When the device 500*c* moves in a downward direction the elements 558*c* can be configured to move slightly to a substantially perpendicular orientation or greater angle 557*c*. When the downward movement substantially stops, the elements 558*c* will move back towards their normal position and push debris away. In one embodiment the movement back towards the normal position can be a snapping motion to exert force on any accumulated debris to push the debris out. In one embodiment a limiting device 559*c* can be included to prevent each element 558*c* from moving beyond a predetermined position. This can be used to allow each element 558*c* to provide a firm barrier against the shoe in an uppermost position. Although a plurality of elements 558*c* are shown in this example, in alternate embodiments any number of elements can be used, including one. Although in the example shown in FIG. 5C each element 558*c* is shown as having a substantially equal length, in alternate embodiments the length of each element 558*c* can be varied. For example in one embodiment it may be advantageous for the uppermost element to have a longer length than the lowermost element. The in-between elements can be proportionally sized. FIG. 5B illustrates an example of a complementary ridgeline 556*d* that includes one or more elements 554*d*. The elements 554*d* can be similar to those described with respect to the elements shown in FIG. 5C. In one embodiment the elements 554*d* can comprise a more rigid material configured to maintain a relative position which can be either perpendicular or angled. In this way some debris may be trapped in each area 553*d* and other loose debris pushed away by the device 555*d*.

The debris protection device 100 generally comprises any suitable material that provides flexibility and durability. The debris protection device 100 can be constructed of a flexible material or fabric so as not to impair the user's performance while wearing a shoe configured with the device 100. The material may also be durable to resist abrasion and cuts, comfortable and breathable so as not to cause skin irritation or itching, and elastic to stretch with muscular exertion and other movement in the lower leg. One intended use of the device 100 is in athletics where the device will be subject to strenuous use, environmental conditions and other extreme use factors. The material must be able to withstand normal wear and tear that it will be exposed to under such conditions, such as for example a football or lacrosse game. In an exemplary embodiment, examples of suitable material for the debris protection device 100 include comfort-fit neoprene. In alternate embodiments, any suitable material can be used that achieves one or more of the above-mentioned advantages. In still other embodiments the debris protection device 100 can be constructed of two or more different types of material having different properties and qualities (e.g. toughness, flexibility, texture, etc. that will endure the requirements of athletic activities and performance). For example, portions of the debris protection device subject to abrasion may be constructed of a tougher material than other portions of the protection device 100. In one embodiment, material that can be used in areas of the device 100 subject to, for example, abrasion can include, but are not limited to, abrasion resistant fabrics such as nylon, canvas, leather or polymer impregnated or coated materials.

In one embodiment the device 100 can be ribbed to provide additional flexibility and compression capability since the device 100 will be subject to up-and-down and lateral motion. The ribbing should provide better up-and-down and lateral movement of the device 100 to correspond with movement of the shoe. In one embodiment the device 100 can also include vent type apertures that provide ventilation. The apertures can include a suitable screen or mesh material that allows air to pass in and out of an interior region between the device 100 and the user's foot and shoe. The screen or mesh is of a suitable size and material to not allow debris to pass through. The screen or mesh material will also also be flexible to be able to move and compress in an up-and-down and lateral fashion. Any suitable number of apertures can be provided, and the shape of each aperture can be any suitable shape.

The material can naturally form-fit, through surface friction, to form a natural friction bond between the device 100 and both the ankle and shoe to provide a barrier to prevent the entry of debris, such as for example, the rubberized pellets from the aforementioned turf fields.

In one embodiment, the debris protection device 100 can be secured or attached to the footwear in any suitable manner to provide a more secure fit and substantially prevent movement or separation of the debris protection device 100 from the footwear during activity. Securing the debris protection device 100 in place can be accomplished in any suitable manner, including, but not limited to the natural friction bonds created by the form fitting material, artificial friction bonds and the grommets 160A, 160B (e.g. FIGS. 1B, 2B, 2C and 3).

The natural friction bonds between the device 100 and the user's ankle and shoe 110 will substantially prevent movement or separation of the device 100 from the ankle and shoe 110. In one embodiment, the upper portion or "top" area 125 of the device can be configured to fit over the ankle/sock, or other suitable leg garment, and form the friction bond 120 to the underlying object. In other embodiments the friction bond may be formed with the user's skin in a non-irritating manner. Similar natural friction bonds can be formed between the device 100 and the shoe 110. In other embodiments an artificial bond may be formed between the device 100 and one or more of the user's ankle and shoe 110. For example, additional material can be added to the user's ankle (via a removable band, sock, or other removable object) that interacts with the material of the device 100. One example of an artificial frictional bond can be hook and loop fasteners or hooks/bristles that interact with, for example, the user's sock. Similarly friction material can be attached to the upper portion 115 of the shoe 110 so that the friction material interacts with the device 100 in a manner substantially similar to that described above. For example, the device 100 can include micro-bristle strips or ridgelines 150 that are attached to, for example, the inside of the debris protection device 100, as will be described below. The ridgelines 150 can be configured to maximize the friction bond of the device against the sides of the shoe 110 and/or the user's ankle or leg. The bristles can be suitably sized so that the bristles grip or interact with the fibers or other textural features of the user's apparel (e.g. socks and/or shoes) so that the device 100 is securely held against the ankle and/or upper part 115 of the shoe 110.

Figure 2A:
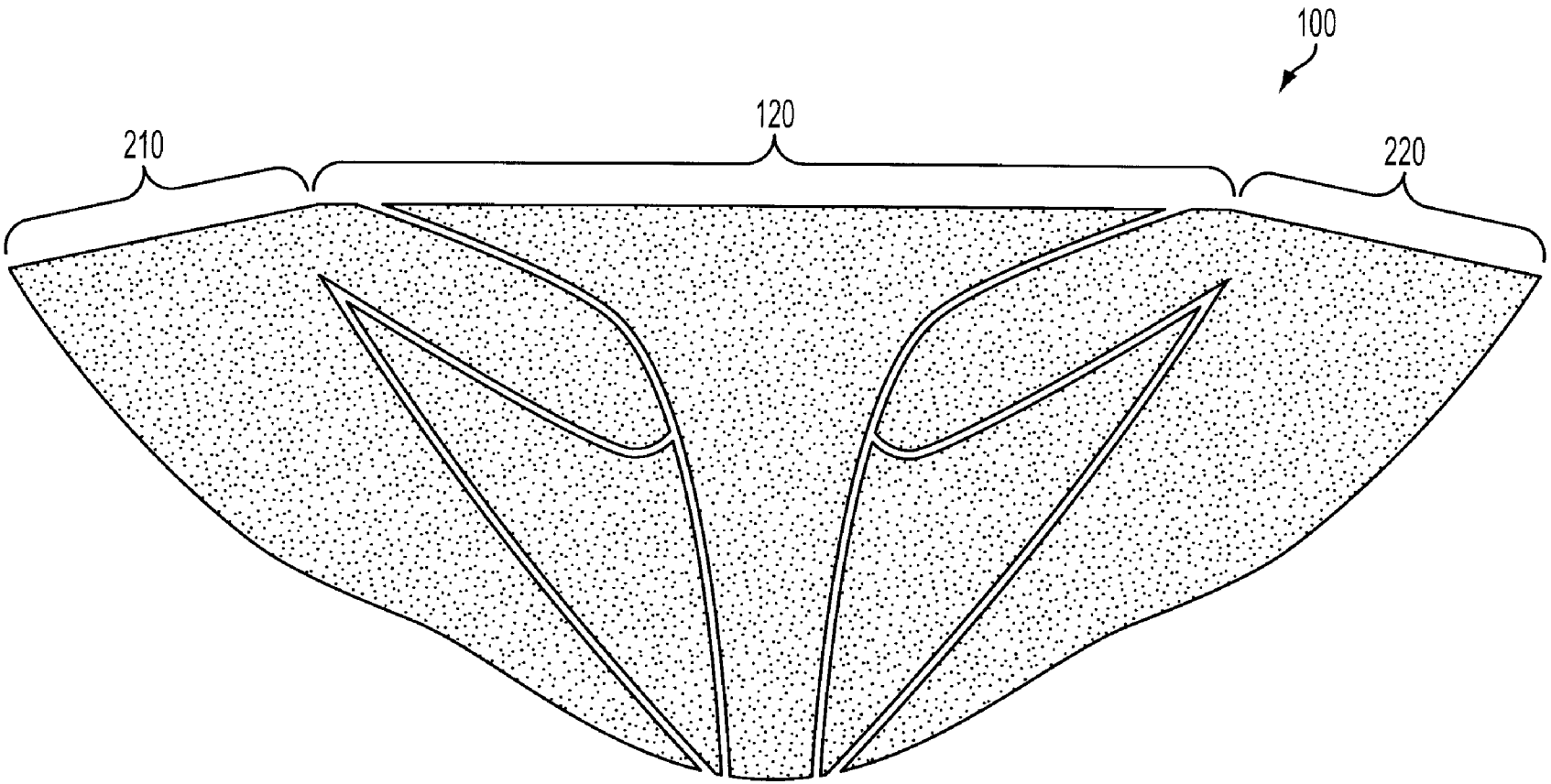
FIGS. 2A, 2B and 2C illustrate plan views of a pattern for a debris protection device in accordance with aspects of the disclosed embodiments.
Figure 2B:
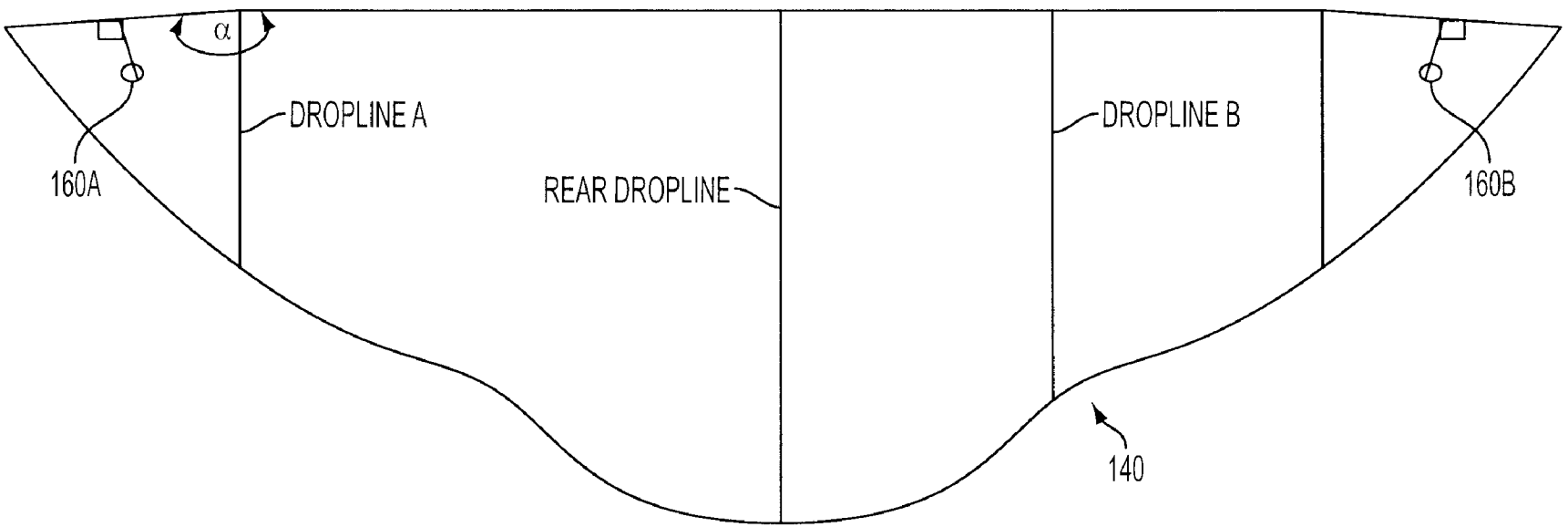
Figure 2C:
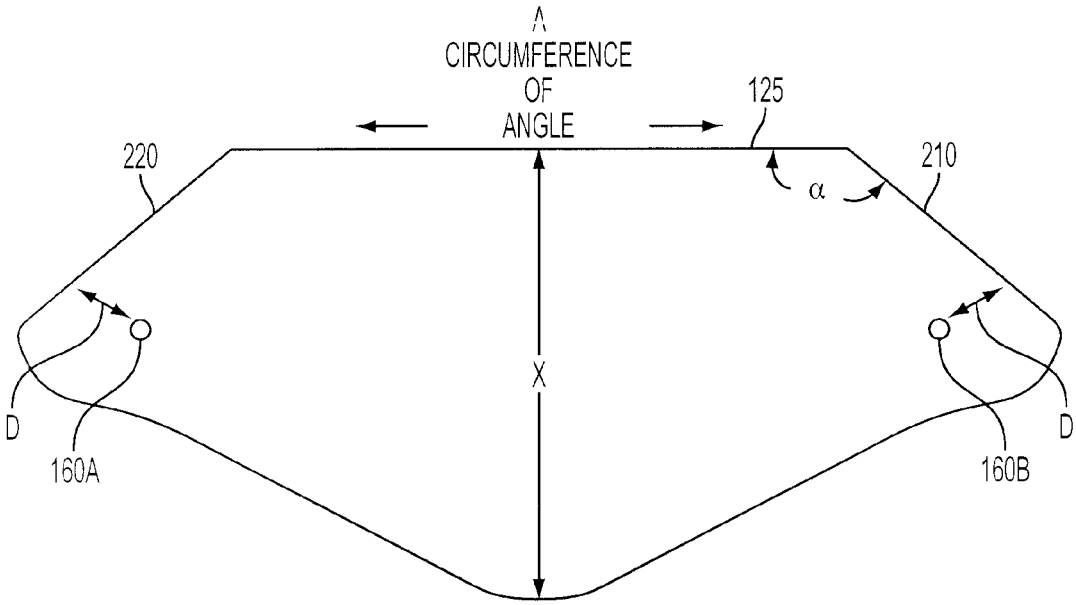
Figure 3:
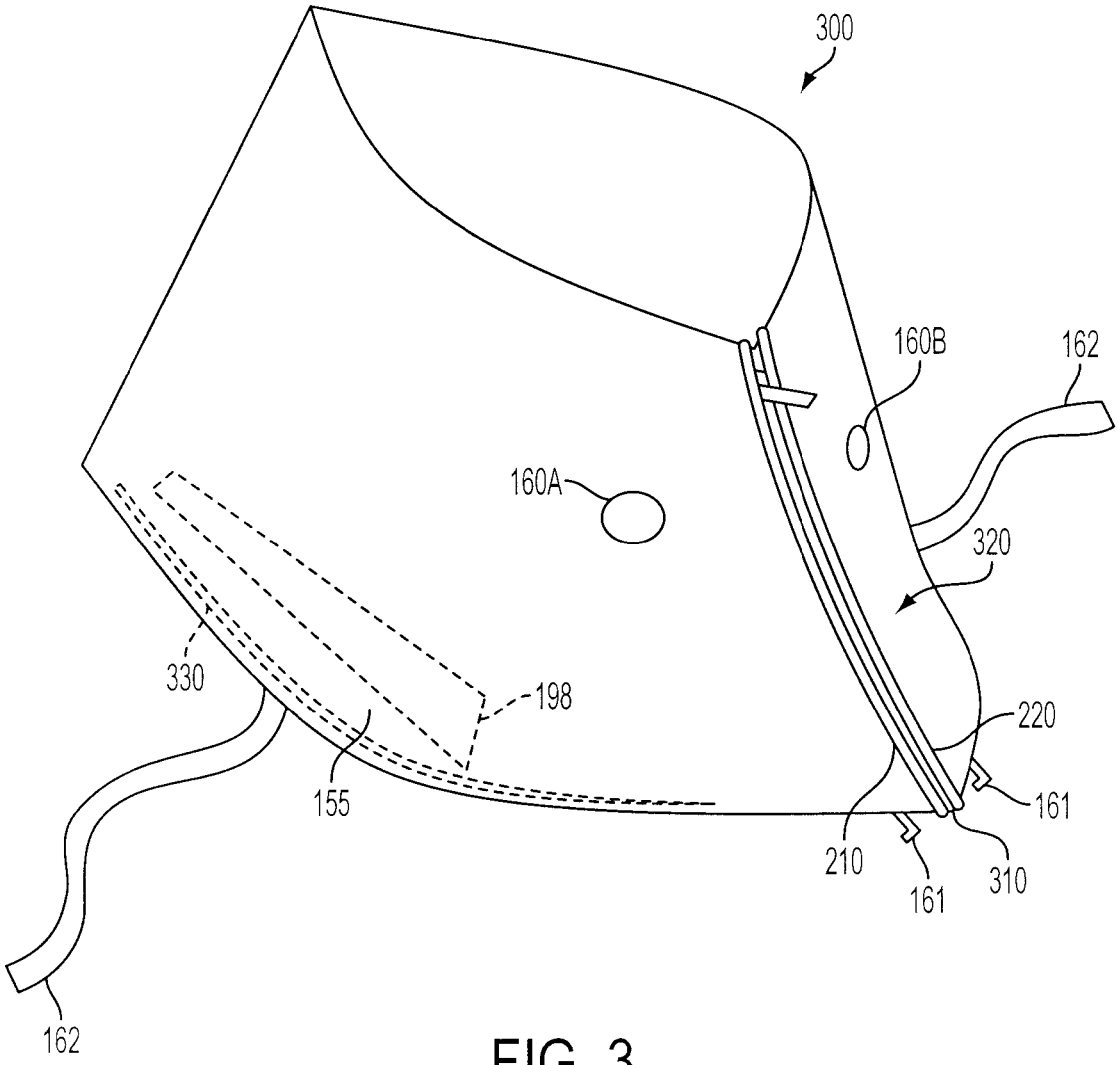
FIG. 3 illustrates a debris protection device in accordance with an aspect of the disclosed embodiments.

In another embodiment the device 100 can include grommets 160A, 160B as can be seen in FIGS. 1B, 2B, 2C and 3, or other similar openings, in the lower front center of the debris protection device 100. The grommets or openings 160A, 160B can be for laces, or such other similar tying devices, to pass through before securing the shoe 110 to the user's foot. In one example, the user can pass the laces of the footwear through one or more of the grommets 160A, 160B or openings to secure the debris protection device 100 to the footwear when the laces of the footwear are tied. The grommets 160A, 160B can be located at any suitable position on the debris protection device 100 for securing the protection device 100 to the shoe 110. In one embodiment, the grommets 160A, 160B can be located about at a distance D from the edges 210, 220 as shown in FIG. 2C. In one embodiment the distance D may be about one inch from the edges 210, 220 while in other embodiments the distance D may be more or less than one inch. It is noted that any suitable number of grommets or openings can be used. In one embodiment the grommets may be spaced along the entirety of edges 210, 220. Extended length laces may be provided on the shoe 110 so that the laces can be inserted through the grommets along the edges 210, 220 in a manner substantially similar to the way the laces pass through the eyelets of the shoe 110 for securing the device 100 to the shoe and for securing the edges 210, 220 to each other. In alternate embodiments, clips or other suitable fasteners can be used in place of laces. For example, when the footwear does not include laces or other similar tying device, any suitable mechanical securing mechanism can be used.

In one embodiment, the grommets 160A, 160B can provide the wearer with a number of lacing options and styles when attaching the device 100 to the shoe. For example, when using four grommets, the laces can be tied underneath the device 100. When the device 100 is zipped up, the laces are hidden, or protected by the device 100. This provides certain advantages, particularly in sports, because the laces are protected and not likely to come undone or be accessible. For example, without laces, soccer players can have a better feel for the ball, football players cannot be tackled by the laces and one cannot trip over long laces or laces that might come undone.

In one embodiment, during use the upper portion or top area 125 of the debris protection device 100 can be positioned or wrapped around the person's calve just above the ankle. This upper portion or member 125 is generally configured to be comfortably secured at a spot on the person's leg in a position superior to an upper most portion of the particular footwear. The lower portion or member 126 is configured to fit over at least the uppermost portion 115 of the footwear. It is noted that sizing of the upper portion 125 as well as the lower portion 126 of the protection device 100 will be configured according to the circumference of any suitable portion of the user's leg (such as for example the person's calve just above the ankle) and/or shoe size.

The debris protection device 100 can be designed with a contour that generally runs in an outward fashion from the upper portion 125 to the lower portion 126 to substantially cover and form a friction bond with the tongue (e.g. front), sides and rear areas of the shoe. In one embodiment is can be described as a reverse funnel design. For example, as shown in FIG. 1B the front of the device 100 is angled to reach from the user's leg to the shoelace eyelets on the shoe whereas the rear of the device 100 is substantially vertical (e.g. perpendicular to the ground when the sole of the shoe is not bent and sitting on the ground). In this manner, the debris protection device 100 "rides" on top of the exterior or outer surface of an upper area or portion 115 of the shoe 110. The contour of the device 100 can be suitably configured to universally fit all makes and styles of shoes including, but not limited to, athletic shoes. As such, the edges 210, 220 can have any suitable angle $\alpha$ with the top portion of the debris protection device 100 as can be seen in FIGS. 2B and 2C. For example, in one embodiment the angle $\alpha$ can be about 167 degrees while in other embodiments the angle can be more or less than 167 degrees.

Referring also to FIG. 2A, in one embodiment, the debris protection device 100 can be formed in a one-piece construction. In one embodiment the edges 210, 220 can be joined together in any suitable manner so as to form the top opening 126 of the debris protection device 100. For example, the edges 210, 220 can be joined by sewing (i.e. stitching) the edges together, adhesives, or by any other suitable mechanical, chemical, or other fasteners. The one-piece construction can allow a person to substantially slip the debris protection device 100 over the foot before putting on a shoe 110, then "snap" the device in a downward motion to form a substantially inverted funnel shape, which might also be described as having a substantially coned shaped appearance. For example, as the user slips the device 100 over the foot in a first direction the interior of the device 100 is facing away from the user's foot/leg. In one embodiment, when the top portion 125 of the device 100 is at a predetermined position along the user's leg the user moves the bottom portion 126 in a second direction that is opposite the first direction so that a fold 127 is formed adjacent the top portion 125 of the device. In other embodiments the fold may not be formed at the top 125 of the device 100 (e.g. the bottom portion 126 is sufficiently moved in the second direction to "flip" the material at the top 125 of the device so there is no fold). The movement of the bottom portion 126 of the device 100 causes the device 100 to "snap"

into the substantially funnel shaped contour described above due to, for example, the shape and construction of the device 100.

In other embodiments, as can be seen in FIG. 3, the edges 210, 220 can be joined together in a detachable manner such as by, for example, a closed end zipper 310 or any other suitable detachable fasteners including, but not limited to hook and loop fasteners, buttons, snaps and hooks. Where a detachable fastening of the edges 210, 220 is used the device 100 can be put on before or after the user puts the shoe 110 on the foot. For example, the user can wrap the device 100 around the user's leg and at least the upper portion 115 of the shoe 110 until the edges 210, 220 meet. The edges 210, 220 can then be fastened to secure the device 100 to the user's leg and the shoe 110. The zipper 310 may maximize the range of sizes and enable the wearer to zip the front of the debris protection device 320 up to a desired comfort level. It is noted that the edges 210, 220 can be completely detachable from each other or only partly detachable from each other (e.g. a portion of the edges remains attached while a different portion of the edges is detached). While the zipper is shown in the Figures as being located in the front portion of the debris protection device 100 it is noted that the zipper can be in any suitable area of the debris protection device 100 such as for example, the sides or back. In one embodiment, the zipper or other suitable fasteners may form at least part of the rear taper support 130 as will be described in greater detail below.

In one embodiment, the debris protection device 100 can also include adjusters 330 (FIG. 3), on one or more sides of the debris protection device 100. The adjusters 330 are configured to enable the wearer to change or configure a shape or form of the bottom 126 of the debris protection device 100 to give it a more customized fit, according to type, style or size of shoe. For example, two adjusters can be used, one on each side of the debris protection device 100, to allow the user to tighten or snug the bottom of the device 100 to the shoe 110. In alternate embodiments, any suitable number of adjusters can be used. The adjusters can be formed of any suitable material and have any suitable style, such as for example, hook and loop fasteners, laces, cords, elastics, or some other mechanical style attachment mechanism. For example, a snap-type mechanism might be suitable in certain applications. In one embodiment similar adjusters can be used to adjust the top area of the device 100.

In one embodiment, the device 100 can also include a rear taper support 130. The rear taper design or support 130 (FIG. 1A) is used to maintain structural integrity of the device 100 and prevents a back portion of the device 100 from riding up the rear of the shoe. The rear taper support 130 may have any suitable length X. For example, in one embodiment the length X may be about two-thirds of the circumference A of the ankle (e.g. length of the top portion 125 of the debris protection device 100) while in other embodiments the length X may be more or less than two-thirds of the circumference A. As motion is introduced to the shoe (for example when running), the rear taper 130 can translate pressure up the sides of the shoe and/or debris protection device to the front of the shoe and/or debris protection device. The rear taper 130 also prevents the sides of the debris protection device 100 material from warping or losing a general shape. The rear taper 130 can be formed from the particular material being used for the debris protection device 100. For example, the material can be folded over itself and/or overlapped so that an area of reinforced material or an integrated stiffening member 131 is formed as can be seen in FIG. 1C. The folded or overlapped material can be held in a folded or overlapped position in any suitable manner including, but not limited to, stitching 132 or adhesives. The integrated stiffening member 131 is configured to provide structural integrity to the rear taper 130. In alternate embodiments, other mechanisms can be used to provide structural integrity, such as for example, plastic style strips or pieces 133 that are inserted into or otherwise affixed to the debris protection device 100. In still other embodiments, the zipper 310 can be located at the rear portion of the device 100 and act as the rear support 130.

Because the debris protection device 100 sits on the exterior of the shoe upper, it creates an opportunity for image promotion and advertising. In one embodiment, the debris protection device 100 material will be configured to allow for using customized colors, design patterns, screening, logos and numbers that are applied in any suitable manner including, but not limited to dye sublimation, embroidery and silk screening. Teams, organizations and advertising sponsors can have their logos applied to any suitable portion of the debris protection device 100 in any suitable manner. Individual athletes can have their numbers or names applied to the debris protection device 100 to any portion of the debris protection device 100 in any suitable manner.

The debris protection device 100 system is generally designed in substantially funnel shaped contour to form a barrier between the ankle of the user and the footwear and maximize the surface friction against the outside of the footwear. The top of the device 100 can form a friction bond with the ankle, while being contoured in a generally outward direction to cover and form a friction bond with the tongue, sides and rear of the footwear. A rear taper support can be used to maintain structural integrity by preventing the back of the material from riding up the rear of the footwear. As motion is introduced during use, for example while running, the rear taper translates pressure up the sides of the shoe to the front. The rear taper will also prevent the sides of the material from warping.

It is also noted that due to the nature of the substantially funnel shaped and breathable elastic material, the debris protection device 100 is configured to keep shoes, and even socks, dryer in wet conditions by channeling moisture or water out of or away from the shoes in the same manner as described above with respect to the debris.

The disclosed embodiments provide a system that will channel certain debris away from entering the inside of a shoe. The device is configured to wrap around a person's calve above the ankle and interface with the upper region of the wearer's shoe. One or more ridgelines can be used to help block and sweep away debris that might infiltrate the area between the device and the shoe. The device does not impair user performance and provides advantages previously recognized.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A footwear apparatus comprising:

a flexible one piece member for removable attachment to a footwear device, the flexible member having a top edge portion and a bottom edge portion, a first side member, a second side member and a middle member between the top and bottom edge, the middle member being disposed between the first and second side members;

an end portion at an outer edge of each the first and second side members, distal from the middle member; and a lace attachment member in at least one of the end portions;

wherein each of the top and bottom edge portions are substantially parallel to each other along the middle member, and each bottom edge portion is angled upwards relative to the top edge portion from a point beginning at the middle member and continuing to the end portion; the top edge portion forming an opening configured to engage a user's leg, and the bottom edge portion forming an opening configured to engage a top portion of the footwear device; and a pair of first brush members, each first brush member attached to an inside portion of each of the first and second side members adjacent to the bottom edge portion, each brush member having a thickness sufficient for an outer surface of the brush member to slidably engage a corresponding surface of the footwear device; and a taper support device disposed vertically along a substantially centerline of the middle portion from the top edge to the bottom edge, the taper support device being a semi-rigid member and configured to substantially stiffen the middle portion from the top edge to the bottom edge.

2. The footwear device of claim 1, wherein the eyelet member comprises a first eyelet and a second eyelet, the first eyelet being positioned adjacent to an outer edge of the end portion and the second eyelet being positioned in a linear relation with the first eyelet and approximately one-inch from the first eyelet.

3. The footwear device of claim 1, wherein each brush member comprises a plurality of brush elements, the brush elements disposed in a spaced apart relationship from a lowermost brush element adjacent to the bottom edge portion to an uppermost brush element adjacent to the top edge portion, a length of the uppermost brush element being longer than a length of the lowermost brush element.

4. The footwear device of claim 1, wherein the taper support comprises a folded over part of the middle portion, the folded over part being stitched together.

5. The footwear device of claim 1, wherein the taper support comprises a plastic member.

6. The footwear device of claim 1, wherein the taper support comprises a zipper joining corresponding edges of the middle portion together.

7. The footwear apparatus of claim 1, wherein the top edge portion forms a top opening, the top edge portion configured to extend above a top of the footwear device and engage a leg portion a user of the footwear device, the top edge portion being arranged substantially parallel to a sole of the footwear device.

8. The footwear apparatus of claim 1, wherein the bottom edge portion forms an opening, the bottom edge portion configured to engage an upper portion of the footwear device, the bottom edge portion being non-parallel to a sole of the footwear device.

9. The footwear apparatus of claim 1, wherein the first brush member further comprises a portion of a velcro style fastener, the portion of the Velcro style fastener extending along the bottom edge portion of each side from a point substantially near the middle member to each end portion.

10. The footwear apparatus of claim 1, wherein the one-piece member comprises neoprene.

11. The footwear apparatus of claim 1, comprising a forward facing portion and a rearward facing portion, relative to the footwear device, the forward facing portion comprising each end portion joined together, the rearward facing portion comprising the middle portion.

12. The footwear apparatus of claim 11, wherein a height of the rearward facing portion is greater than a height of the forward facing portion, the bottom edge portion being angled relative to the top edge portion.

13. The footwear apparatus of claim 12, wherein a length of the forward facing portion extends only partway down a front of the footwear device.

14. The footwear apparatus of claim 1, the footwear apparatus being attached to a footwear device, wherein a lace member of the footwear device is received by the eyelet of the footwear apparatus.

15. A footwear apparatus, comprising:

a flexible, single piece member, having a first side member and a second side member;

a back member joining one end of the first and second side member;

a joining member joining an other end of the first and second side member;

an upper edge of each of the first side member and second side member substantially perpendicular to the back member;

a lower edge of each of the first side member and second side member of the single piece member forming an angle relative to the upper edge;

a sweep device disposed along an inner side of the footwear device adjacent to the lower edge on each of the first and second side member;

a brush member of the sweep device extending away from the inner side of the footwear device, the brush member configured to translate in an upward and downward direction relative to the footwear apparatus and slidingly engage a corresponding surface of a shoe to which the footwear apparatus is attached; and wherein the sweep device comprises a plurality of brush members, the brush members disposed in a spaced apart relationship from a lowermost brush member adjacent to the lower edge to an uppermost brush member adjacent to the upper edge, a length of the uppermost brush member being greater than a length of the lowermost brush member.

16. The footwear apparatus of claim 15 further comprising:

a limiting member disposed on the inner side of the footwear device above and in close proximity to the sweep device, the limiting member configured to limit an amount of translation of the brush member in the upwards direction.

17. The footwear apparatus of claim 15 wherein the brush member is oriented at angle of 90 degrees or less, relative to the inner side of the device.

18. A debris protection device attachable to a footwear device, comprising:

a single piece neoprene member having a first end and a second end;

a joining member in each of the first end and the second end;

a front portion joining the first end and the second end;

a back portion, the back portion comprising a substantially rigid member extending vertically along a substantial centerline of the back portion;

a height of the back portion being greater than a height of the front portion;

the front portion being disposed at an angle relative to the back portion;

a pair of side members between the front portion and the back portion;

a brush member disposed on an inside surface of each side member adjacent to a lower edge of the side member, the brush member having bristles that extend in a substantially perpendicular direction away from the inside surface, the bristles having a length configured to slidingly engage a corresponding outer surface area of the footwear device;

a semi-rigid taper support disposed along the back portion; and the single piece neoprene member forming a top opening when the first end and the second end are joined together and a bottom opening, a diameter of the top opening being less than a diameter of the bottom opening, the bottom opening engaging an upper portion of the footwear device.

* * * * *